US006685064B2

(12) United States Patent
Frutin

(10) Patent No.: US 6,685,064 B2
(45) Date of Patent: Feb. 3, 2004

(54) DISPENSING APPARATUS

(75) Inventor: Bernard Derek Frutin, Uplawmoor (GB)

(73) Assignee: Rocep Lusol Holdings Limited, Deanpark (GB)

( * ) Notice: Subject to any disclaimer, the term of this patent is extended or adjusted under 35 U.S.C. 154(b) by 0 days.

(21) Appl. No.: 10/169,290

(22) PCT Filed: Dec. 22, 2000

(86) PCT No.: PCT/GB00/04967

§ 371 (c)(1),
(2), (4) Date: Aug. 13, 2002

(87) PCT Pub. No.: WO01/49585

PCT Pub. Date: Jul. 12, 2001

(65) Prior Publication Data

US 2003/0038148 A1 Feb. 27, 2003

(30) Foreign Application Priority Data

Dec. 30, 1999 (GB) ..... 9930773

(51) Int. Cl.[7] ..... B65D 83/00

(52) U.S. Cl. ..... 222/402.15; 222/402.21; 222/153.12

(58) Field of Search ..... 222/402.1, 402.2, 222/402.15, 402.23, 402.11, 402.16, 402.14, 402.21, 402.22, 402.25, 153.11, 153.12, 153.13, 153.14, 389, 380

(56) References Cited

U.S. PATENT DOCUMENTS 2,766,913 A * 10/1956 Wilshusen ..... 222/402.22
2,892,572 A * 6/1959 Fredette et al. ..... 222/153.06
3,395,838 A * 8/1968 Beres et al. ..... 222/402.14
4,454,963 A * 6/1984 Fegley ..... 222/5
4,669,639 A * 6/1987 Klarenbach et al. ..... 222/396
4,826,054 A * 5/1989 Frutin ..... 222/402.11
5,040,705 A 8/1991 Snell
6,003,740 A 12/1999 Castaneda, Jr.
6,321,951 B1 * 11/2001 Frutin ..... 222/389
6,340,103 B1 * 1/2002 Scheindel et al. ..... 222/402.15
6,474,510 B2 * 11/2002 Frutin ..... 222/153.11

FOREIGN PATENT DOCUMENTS

| | | |
|---|---|---|
| EP | 0243393 B | 11/1987 |
| GB | 1359152 A | 7/1974 |
| WO | WO 9830469 A | 7/1998 |
| WO | WO 9918010 A | 4/1999 |

* cited by examiner

*Primary Examiner*—Gene Mancene
*Assistant Examiner*—Frederick C. Nicolas
(74) *Attorney, Agent, or Firm*—Drinker Biddle & Reath LLP

(57) ABSTRACT

A dispensing apparatus (10) for dispensing a product from a container (12) includes: a product chamber within the container (12); a valve (14) adjacent to the product chamber; a hinge assembly secured to the opening of the container and to which is connected a nozzle assembly (20); and a lever (18) attached by means of the hinge assembly. The nozzle assembly (20) is rotatable between open and closed positions and includes an actuator portion provided with a cam surface (96, 98) which co-operates with a bearing portion (100) on the lever (18) such that, when the nozzle assembly (20) is in the open position, operation of the lever (18) causes movement of the actuator portion to open the valve (14) and permit flow of the product out of the container (12).

9 Claims, 6 Drawing Sheets

12
86
70
84b
18
84a 86
12
70
18

12
70
18

82
10
20
92
70
16
18
102
14
12

82
80
10
20
70
16
18
102
14
12
12

80
10
20
70
16
18
102
14
12

DISPENSING APPARATUS

SUMMARY OF THE INVENTION

This invention relates to dispensing apparatus. Particularly, but not exclusively it relates to dispensing apparatus for dispensing viscous materials from a container under pressure of a propellant.

Known dispensing apparatus commonly includes a valve mechanism fitted to a container which is refilled with a product, for example mastic or sealant, which is to be dispensed. Examples are disclosed in Patent document EP-B-0243393 (Rocep Lusol Holdings Limited). However, known arrangements have several disadvantages. For example, the cost of components used in the manufacture of such known apparatus is high. The valve mechanism comprises a large number of separate parts which must be assembled together. Automatic assembly of such apparatus is complicated and costly.

It is an object of the present invention to provide a dispensing apparatus which overcomes one or more of the above disadvantages.

According to the present invention there is provided a dispensing apparatus for dispensing a product from a container, said apparatus comprising:

- a product chamber within the container;
- a valve adjacent to the product chamber;
- a hinge assembly;
- a lever hingedly attached to the hinge assembly and having a bearing portion; and
- a nozzle assembly sealingly engageable with the hinge assembly, the nozzle assembly being rotatable between open and closed positions and including an actuator portion provided with a cam surface which cooperates with the lever bearing portion such that in the open position operation of the lever causes movement of the actuator portion to open the valve and permit flow of the product out of the apparatus.

Preferably the apparatus comprises means for urging the product from the product chamber. Preferably the product chamber is pressurised. The product chamber may contain a propellant. The product chamber may contain a piston, situated between the propellant and the valve.

Preferably the valve is a tilt valve. Tilt valves are generally known in dispensing apparatus and operate by tilting of a hollow central stem which is resiliently held on a mounting cup by a rubber grommet. The stem is closed at its lower end by a sealing plate. When the stem is tilted, the seal between the grommet and the sealing plate is broken and the product can reach apertures in the central stem and thence flow along the hollow stem.

Preferably the valve comprises a mounting cup adapted to secure the valve to the container. Preferably the container is provided with a rolled flange portion and the mounting cup is provided with a corresponding flange portion adapted to engage with the rolled flange portion of the container.

Preferably the actuator portion comprises a ring member arranged at a lower end of the nozzle assembly. Preferably the cam surface comprises one or more depressions and one or more raised surfaces. Preferably when the nozzle assembly is in the closed position the lever bearing portion is adapted to bear upon one of said depressions, and when the nozzle assembly is in the open position the lever bearing portion is adapted to bear upon one of said raised surfaces.

Preferably the lever comprises two lever bearing portions arranged at opposite sides of the valve. Preferably the cam surface comprises two depressions arranged at opposite sides of the ring and two raised surfaces arranged between the depressions at opposite sides of the ring.

Preferably the nozzle assembly is provided with means to limit the rotational travel of the nozzle assembly between the closed position and the open position. These means may comprise two end stops provided on the nozzle assembly adapted to locate against an upstand on the hinge assembly.

The nozzle assembly may be provided with fin members adapted to hold the lever bearing portion against the cam surface. The fin members may be of different lengths. Preferably a fin member is provided at each depression and each raised surface of the cam surface, spaced from the cam surface to allow the insertion of the lever bearing portion between the fin member and the cam surface.

Preferably the nozzle assembly comprises one or more dog teeth and the hinge assembly comprises one or more slots, adapted such that a dog tooth can enter a slot only when the nozzle assembly is in the open position. The nozzle assembly is preferably coupled to the valve stem for longitudinal movement, such that movement of the nozzle assembly towards the container causes the dog tooth to enter the slot and the valve stem to move, thereby opening the valve to release the product.

Preferably, the container is made substantially from aluminium and is most preferably an aluminium monoblock container. Alternatively the container may be a wall ironed tin plate can, or an extruded tin plate can as used in the beverage industry, without a side seam.

BRIEF DESCRIPTION OF THE DRAWINGS

Specific embodiments of the invention will now be described, by way of example only, with reference to the accompanying drawings in which:

FIG. 7(*e*) is an end view on the hinge assembly of FIG. 7(*d*);

FIGS. 7(*f*), 7(*g*) and 7(*h*) are a bottom view, side view and top view respectively of the nozzle assembly of the apparatus of FIG. 1(*a*)

DETAILED DESCRIPTION OF THE DRAWINGS

Figures 1A, 1B, 2A, 2B, 3A, 3B:
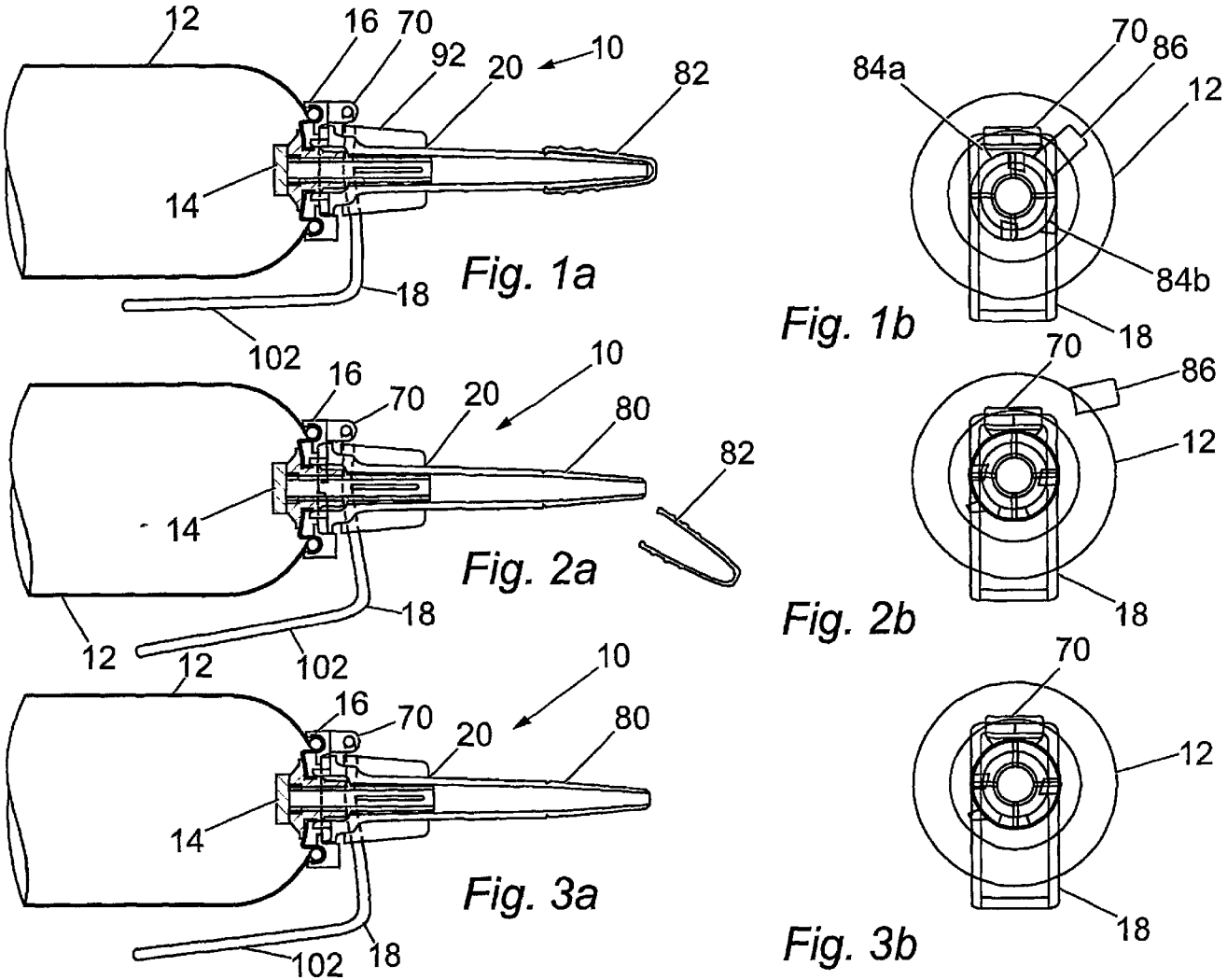
FIGS. 1(*a*) and 1(*b*) are a side view in cross-section and an end view respectively of a dispensing apparatus in accordance with an embodiment of the present invention in a closed position.
FIGS. 2(*a*) and 2(*b*) are a side view in cross-section and an end view respectively of the dispensing apparatus of FIGS. 1(*a*) and 1(*b*) in an open position with the valve closed.
FIGS. 3(*a*) and 3(*b*) are a side view in cross-section and an end view respectively of the dispensing apparatus of FIGS. 1(*a*) and 1(*b*) in an open position with the valve open.

Referring to FIGS. 1 to 7 of the accompanying drawings, an apparatus in accordance with an embodiment of the present invention will be described. The apparatus will be referred to hereinafter as a "pressure pack" or "pack". The pressure pack of FIGS. 1 to 3 is generally denoted 10.

The pack 10 consists generally of a canister section and a valve section.

In this example, the canister section 12 comprises an aluminium monoblock container of the sort widely used in aerosol applications. It is envisaged that the can 12 could he of tin plate, steel or any conventional can construction having a standard one inch (25 mm) hole in the top. The can may be internally lacquered.

The pack 10 is automatically assembled as follows. Firstly a subassembly is formed from a valve 14, a hinge assembly 16, a lever 18 and an actuating nozzle 20. The valve is a tilt valve of the type widely used in pressurised dispensers and operated by tilting the valve stem 30. The valve stem 30 is a hollow plastic tube with apertures 32 in the tube wall at the lower end. The upper end 34 is open, while the lower end is closed by a plastic sealing disc 36. A resilient grommet 38 of rubber or synthetic material surrounds the lower portion of the stem 30 and is held in place by the sealing disc 36 and a retaining collar 31 formed on the outside of the stem 30.

The grommet 38 is provided with a circumferential groove 40 and a sealing web 42 which house a mounting cup 44 of metal. The mounting cup has an inner flange 46, which sits sealingly inside the groove 40 on the grommet, and an outer flange 48 which is adapted to fit around a rolled flange 13 which extends around the opening of the container 12. When the stem 30 is pushed in the direction of arrow A relative to the mounting cup 44, the sealing disc 36 is pushed away from the grommet 38, and material in the canister 12 is free to pass between the sealing disc 36 and grommet 38, through the apertures 32, along the inner bore of the stem 30 and through the open end 34 of the stem. When the stem is released, the resilience of the grommet 38 pushes the stem back in a direction opposite to arrow A and seals the valve again. If the stem is pushed to one side in the direction of arrow B, one side of the sealing disc 36 is pushed away from the grommet 38, and material in the canister 12 is again free to pass between one side of the sealing disc 36 and grommet 38, through the apertures 32, and out of the stem 30. The hinge assembly can be seen more clearly in FIGS. 7(*d*) and 7(*e*). The hinge assembly 16 is moulded from plastic and comprises a ring 60 having a central aperture 62. The ring 60 is provided with a circumferential groove 64 adapted to snap on to the outer flange 48 of the mounting cup. A discontinuous flange 66 projects into the aperture 62, forming two slots 68, whose purpose is explained later. An upstand 70 is provided with a through bore 72 adapted to house the ends of a wire lever 18, thereby forming a hinge for the lever. The lever 18 comprises a handle 102, which extends along the side of the canister 12, and a lever arm 104. The lever 18 is preferably formed from a single piece of wire, whose two free ends are mounted in opposite sides of the upstand 70.

The nozzle assembly 20 comprises an elongate tapering nozzle 80 with a removable end cap 82, which may be click-fit, screw-fit or simple taper fit. The nozzle assembly is free to rotate about its longitudinal axis relative to the hinge assembly 16 and lever 18.

In the illustrated embodiment of FIGS. 1 to 7 the rotation is limited by two end stops 84*a* and 84*b*, which come into contact with bevelled contact surfaces 74*a* and 74*b* formed on the upstand 70 of the hinge assembly 16. When end stop 84*a* is in contact with surface 74*a*, the nozzle is in the closed position. When the nozzle is rotated by 45° in a counter-clockwise direction, so that end stop 84*b* is in contact with surface 74*b*, then the nozzle is in the open position.

When the dispenser is transported and is stored before first use, a removable tab 86 attached to the base 90 of the nozzle assembly prevents any rotation of the nozzle from the closed position by bearing on contact surface 74*b* on the upstand 70. only after removal of the tab, by folding and snapping or tearing, can the nozzle be rotated in a counter-clockwise direction. It is to be understood that the provision of a locking tab 86 is optional, and the invention may function without a locking tab.

The nozzle assembly is provided with four fins, two shorter fins 92 and two longer fins 94. The base 90 of the nozzle serves as an actuator to control the opening of the valve and is provided with a cam surface which has two depressions 98 adjacent to the longer fins 94 and two raised surfaces 96 adjacent to the shorter fins 92. The lever arm 104 of the lever 18 has a bearing portion loo which is adapted to fit between the longer fin 94 and the depression 98 when the nozzle assembly is in the closed position. Upon rotation of the nozzle assembly, the longer fin moves away from the bearing portion 100, so that the bearing portion 100 is free to rise, and the cam surface pushes the bearing portion up until it is raised to the level of the raised surface 96, where it is held between the shorter fin 92 and the raised surface 96.

As the bearing portion 100 is raised, the handle 102 on the lever 18 is moved away from the side of the canister 12, from the position shown in FIG. 1(*a*) to that shown in FIG. 1(*b*).

In an alternative embodiment of the invention, not illustrated, the end stops on the nozzle assembly are omitted. The nozzle assembly is provided with an internal thread which mates with an external thread on the valve stem 30. The nozzle assembly is secured to the valve stem by turning in a clockwise direction until the shoulder 120 on the inside of the nozzle bears on the collar 31 on the outside of the valve stem. Further rotation of the nozzle assembly in a clockwise direction causes both the nozzle assembly 20 and the valve stem 30 to rotate together relative to the grommet 38 and can 12. The base of the nozzle has a cam surface, as described previously, but the nozzle assembly does not stop automatically when the open position is reached. A first rotation in the clockwise direction brings the nozzle to the open position, while further rotation in the clockwise direction brings it back to the closed position, and so on.

Referring again to FIGS. 1 to 7, the base 90 of the nozzle is provided with a cylindrical extension 110 which has an internal diameter adapted to fit slidably around the inner flange 46 of the mounting cup 44. The inner surface of the cylindrical extension 110 engages with a protruding part 41 of the grommet 38 adjacent to the groove 40, to form a seal which prevents the product passing between the valve 14 and the nozzle 80.

Arranged outside the extension 110 are two dogs 112, which in the closed position of the nozzle are aligned on top of the flange 66 in the hinge assembly. In this position the nozzle assembly 20 cannot be moved in the direction of arrow A relative to the hinge assembly 16, because the dogs 112 will interfere with the flange 66. However, when the nozzle is rotated to the open position the dogs 112 are aligned with the slots 68 formed by the gaps in the flange 66, and the nozzle assembly 20 can be moved in the direction of arrow A, so that the dogs 112 enter the slots 68.

It is to be understood that the nozzle assembly may be provided with only one dog 112, and the hinge assembly with only one slot 68.

Figure 4:
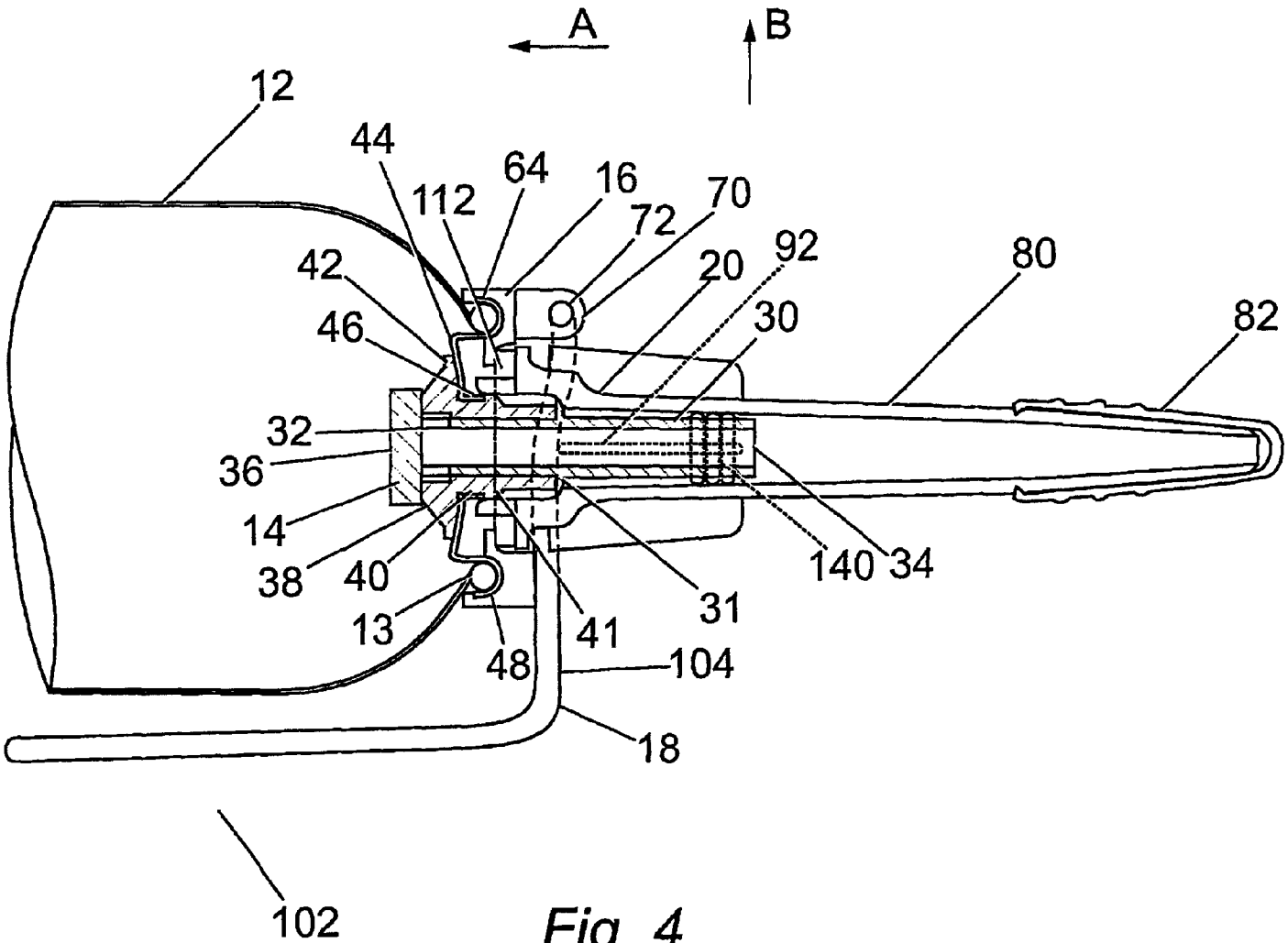
FIG. 4 is an enlarged view of the valve area of the apparatus of FIG. 1(*a*)
Figure 5:
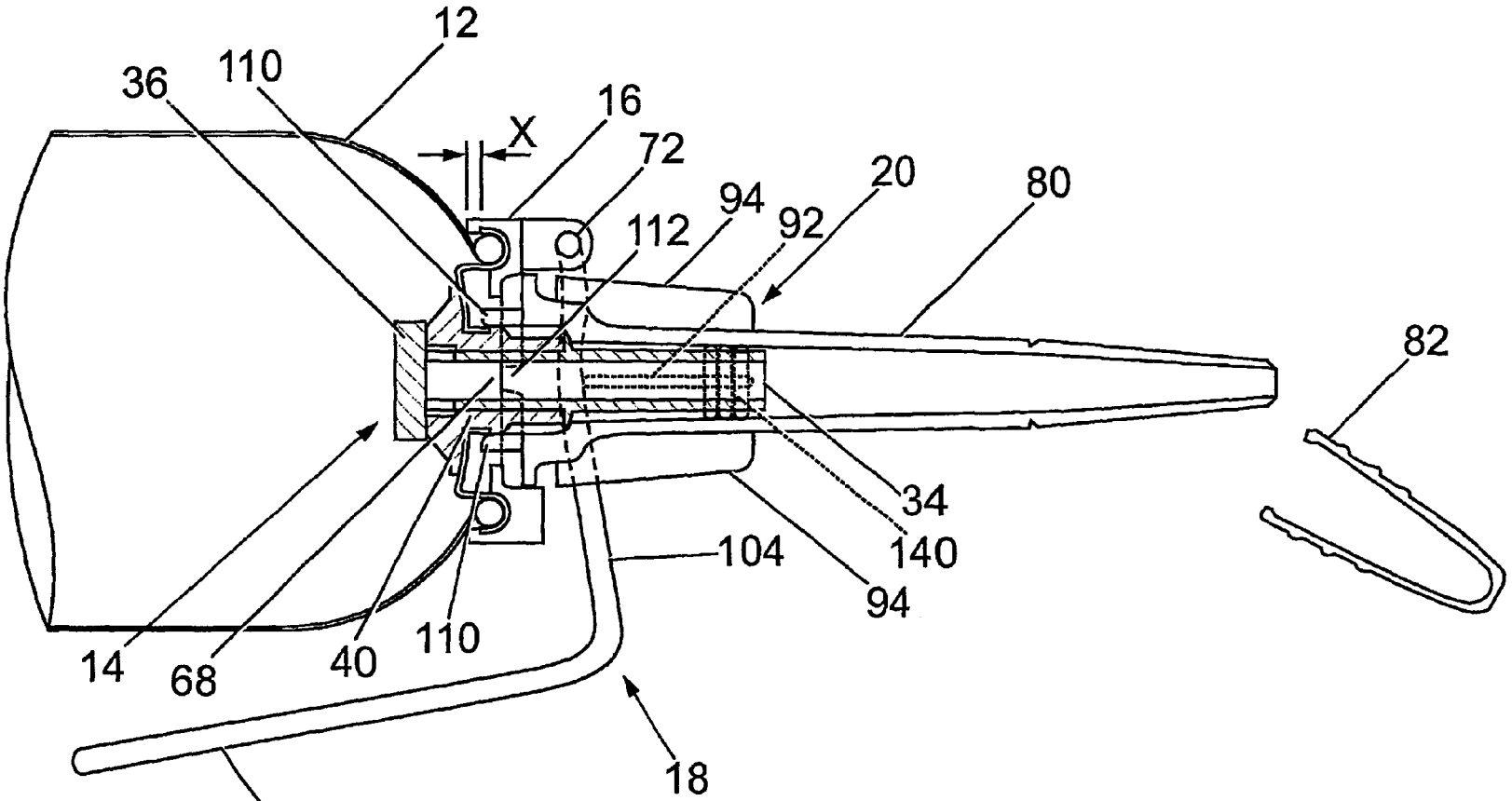
FIG. 5 is an enlarged view of the valve area of the apparatus of FIG. 2(*a*)
Figure 6:
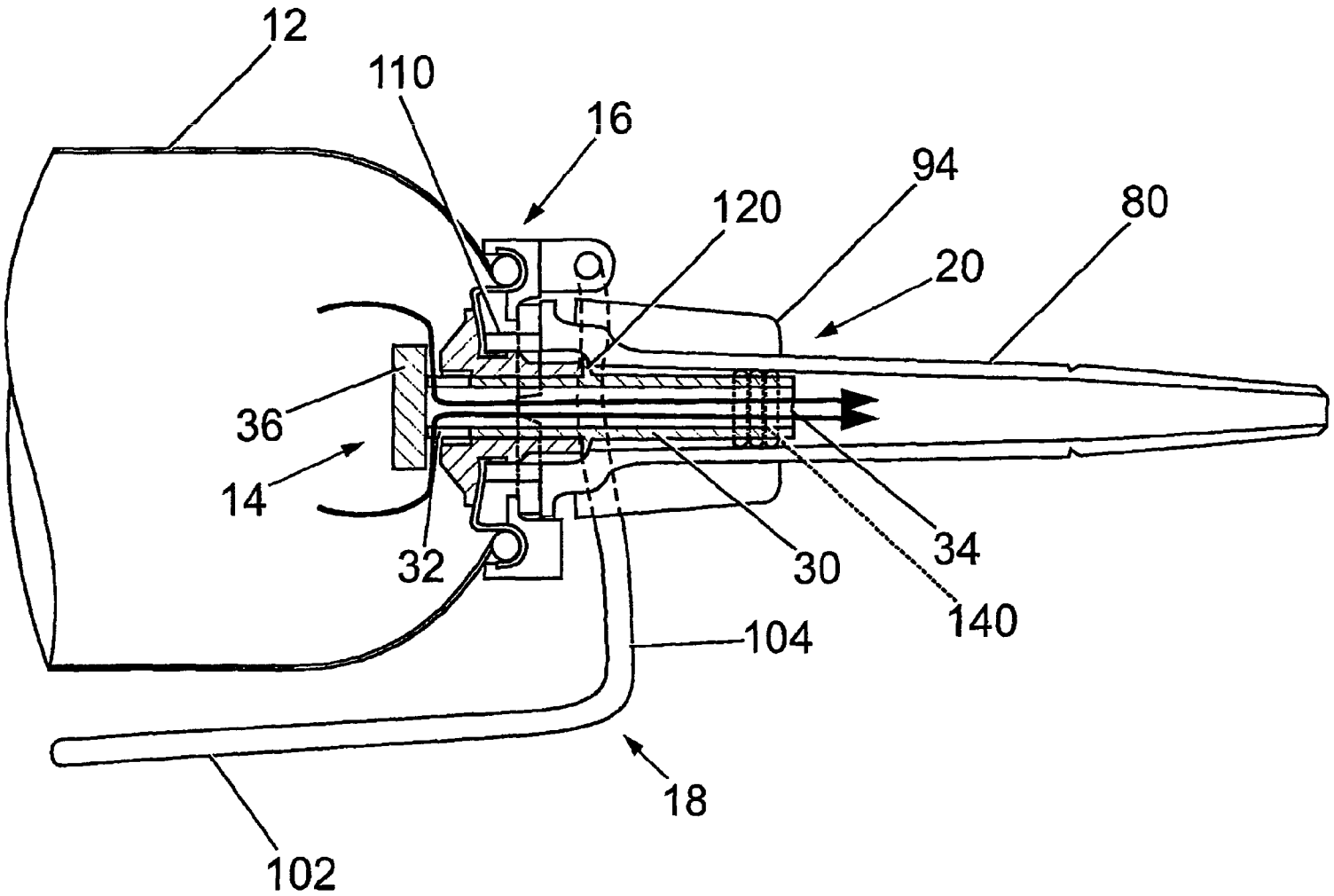
FIG. 6 is an enlarged view of the valve area of the apparatus of FIG. 3(*a*)

When the nozzle assembly is in the open position, as in FIGS. 2 and 3, then depression of the handle 102 towards the canister 12 causes the bearing portion 100 of the lever 18 to push the nozzle assembly 20 in the direction of arrow A towards the hinge assembly 16. The nozzle assembly is linked to the valve stem 30 to prevent relative longitudinal movement of the valve 14 and nozzle 80. The linking means may comprise a thread or a rib and groove arrangement. In the example of FIGS. 4 to 6 three seals 140 are provided on the outer bore of the valve stem 30. These seals 140 seal between the valve stem 30 and the nozzle 80 and prevent product being forced back down between the valve stem 30 and nozzle 80 by back pressure in the nozzle 80.

Figures 7A, 7B, 7C, 7D, 7E, 7F, 7G, 7H:
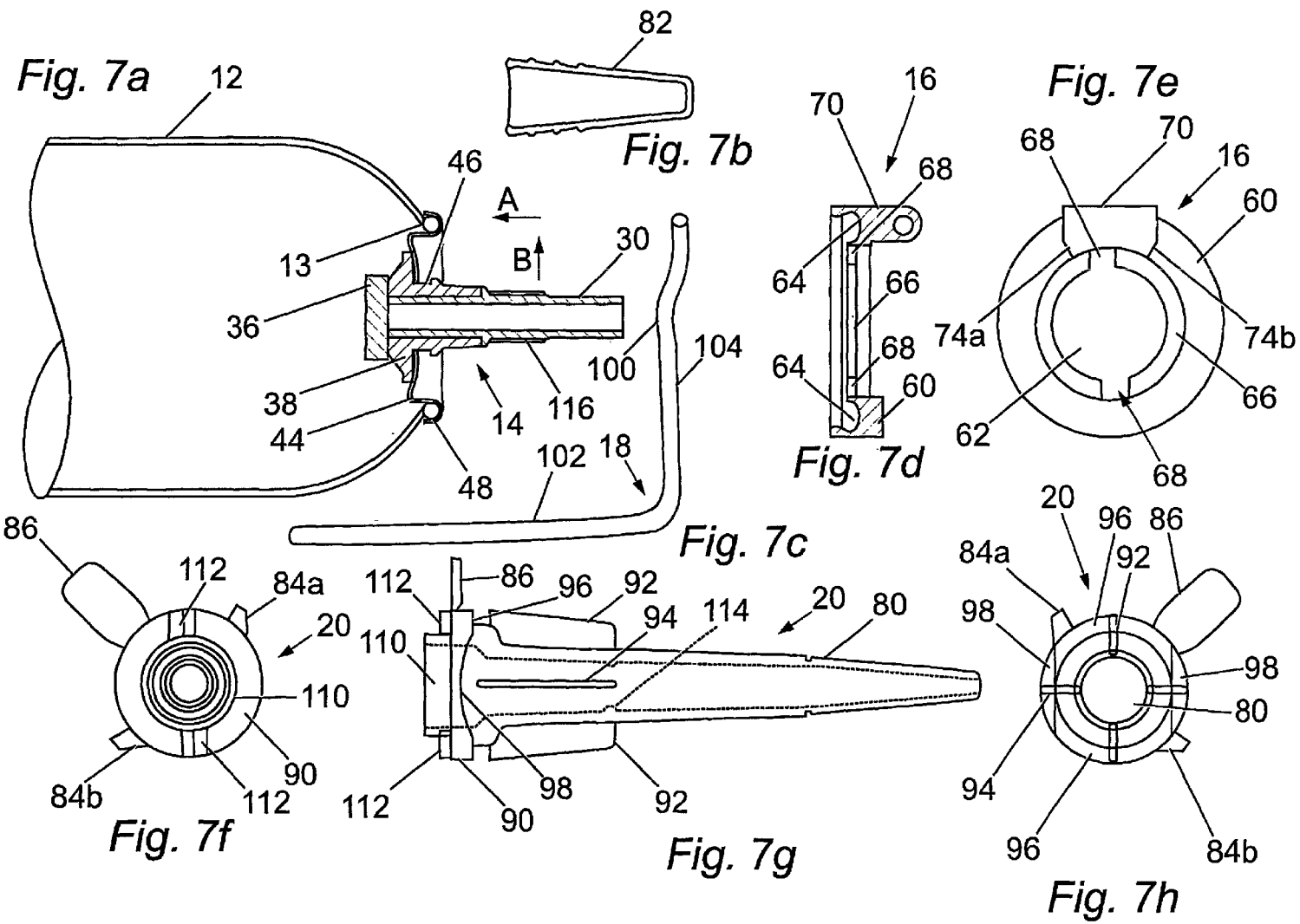
FIGS. 7(*a*), 7(*b*), 7(*c*) and 7(*d*) are sectional views of the valve, nozzle end cap, lever and hinge assembly respectively of the apparatus of FIG. 1(*a*)

An alternative method of sealing is shown in FIG. 7, in which the inside of the nozzle 80 is provided with an annular projection 114 which seals between the nozzle 80 and the valve stem 30 to prevent any product passing between the nozzle 80 and the valve stem 30. An external thread 116 is provided on the valve stem 30 which engages with a corresponding internal thread (not shown) on the nozzle 80 to prevent relative longitudinal movement of the valve 14 and nozzle 80.

As can be seen in FIG. 6, a shoulder 120 on the inside of the nozzle 20 bears on the collar 31 on the outside of the valve stem 30 and pushes the valve stem against the resilience of the grommet 38 in the direction of Arrow A. This causes the disc 36 to move away from the grommet and allow product to be expelled under pressure from the canister through the nozzle 80.

The nozzle assembly 20 is a single moulded piece of plastic. The nozzle assembly 20, the hinge assembly 16 and the lever 18 can be preassembled to form a complete nozzle/hinge sub-assembly and then secured to the canister 12 during the filling process. The nozzle/hinge sub-assembly of the invention is much simpler and cheaper than prior art sub-assemblies, because it uses only three components. The valve, being an off the shelf tilt valve having only three parts, namely the stem 30, grommet 38 and mounting cup 44, may be obtained cheaply and easily. In practice the container is filled, the valve 14 is secured to the container by crimping the flange 48, then the nozzle/hinge assembly is snapped onto the mounting cup of the valve.

The stroke of the valve is limited by the clearance X between the lower end of the extension 110 and the top of the mounting cup 44 adjacent to the inner flange 46. The length of the extension 110 is therefore carefully chosen depending on the flow characteristics of the product to be dispensed.

Before filling the can 12 with product and before fitting the valve and nozzle/hinge assembly, a piston assembly (not shown) is inserted into the can 12. A suitable piston assembly is described in our co-pending International Patent Application No PCT/GB98/03003. However the piston assembly does not form part of the present invention, and any suitable automatic or manual pressure inducing arrangement may be used in connection with the apparatus of the present invention, including conventional aerosol cans.

To dispense a product, the tab 86 is broken, the end cap 82 is removed and the nozzle 80 may be cut open, if it is not supplied already open. The nozzle assembly 20 is then twisted relative to the hinge assembly 16. Twisting is made easy by the provision of the four fins 92, 94, which are readily grasped by hand. A 900 turn will fully open the pack. As the nozzle assembly 20 turns, the lever handle 102 lifts on the hinge 72 due to the action of the camming surface 96, 98 against the bearing portion 100 of the lever arm 104. This can be seen in the view of FIGS. 2(*a*) and 2(*b*).

To dispense product, a user then presses down on the lever handle 102 (moving it toward the body of the can 12). This pushes the nozzle assembly 20 and valve stem 30 down relative to the hinge assembly 16, as described above. This is the position seen in FIGS. 3(*a*) and 3(*b*). Product is then urged to flow, by virtue of the internal pressurisation of the pack through the ports 32 and up through the valve stem 30 and out through the nozzle 80.

To stop dispensing, the user simply releases the lever handle 102. This closes the valve by allowing the valve stem 30 to slide back and close access through the ports 32.

Although FIGS. 1 to 7 show a simple camming surface in which there are two positions, a closed position in which the valve is fully closed and the dog cannot locate in the slot, and an open position in which the valve is fully open and the dog can locate in the slot, it is in the scope of the present invention to provide a more sophisticated camming surface, which may provide intermediate raised surfaces, whose height is between that of the depression 98 and highest raised surface 96. Further slots may be provided in flange 66 corresponding with the intermediate camming surfaces, so that the valve may be actuated in one or more intermediate, partially open positions. Alternatively the dogs 112 and flange 66 may be omitted, thereby simplifying the operation of the apparatus so that the valve can be actuated in any rotational position of the nozzle, the degree of rotation determining the extent to which the valve will open when actuated. Detent grooves may be provided in the camming surface, adapted to cooperate with the bearing portion 100 of the lever, to give a positive click action when the nozzle is rotated to an open position.

Figure 8B:
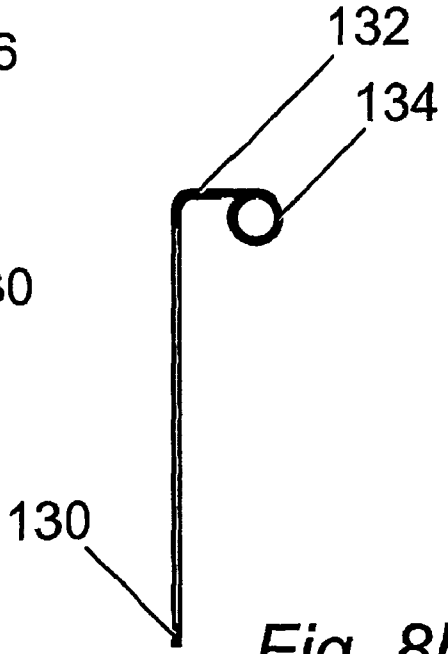
FIGS. 8(*a*), 8(*b*) and 8(*c*) are a bottom view, sectional side view and front view respectively of a hinge assembly of an apparatus according to a second embodiment of the invention.
Figure 8A:
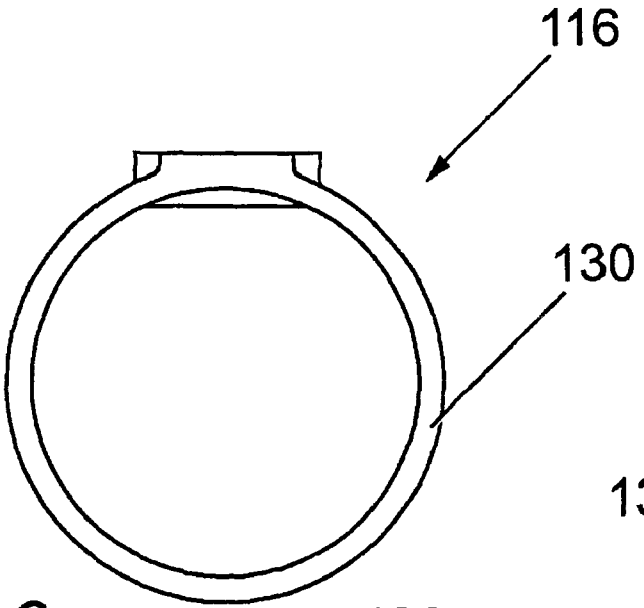
Figure 8C:
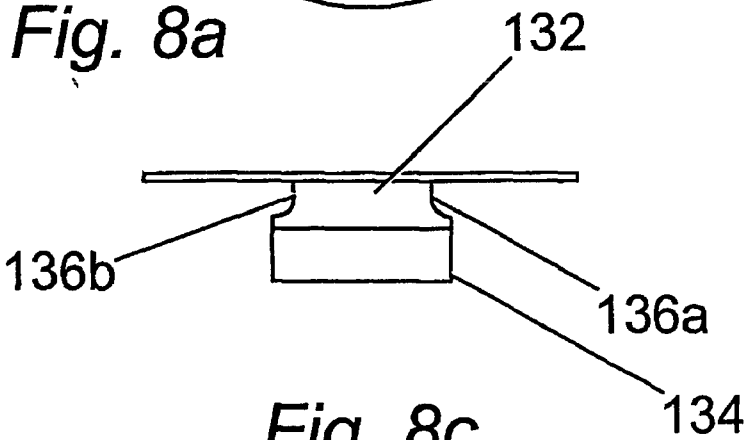

FIG. 8 shows an alternative form of hinge assembly 116, made of steel, alloy or other metal. The assembly comprises a ring 130 which fits around the rolled flange 13 of the container 12 before the mounting cup 44 of the valve 14 is fixed to the flange 13. Fixing the mounting cup holds the ring 130 in place. The upstand 132 and hinge 134 are formed by bending the single flat sheet of metal from which the hinge assembly 116 is formed. The bearing surfaces 136*a*, 136*b* at the end of the upstand 132 serve the same purpose as the bearing surfaces 74*a*, 74*b* described above with reference to FIGS. 7(*d*) and 7(*e*).

Modifications and improvements may be made to the foregoing without departing from the scope of the invention. In particular the dog mechanism may be omitted if there is another means of ensuring that the nozzle is not accidentally depressed, for example the provision of an outer cap which fits over the whole assembly on to the top of the canister. Similarly the fins may be omitted, and the lever may be retained in some other way, or may be free to rise away from the cam surface.

What is claimed is:

1. A dispensing apparatus for dispensing a product from a container, said apparatus comprising:

a container;

a product chamber within the container;

a tilt valve adjacent to the product chamber and having a valve stem provided with an external thread;

a hinge assembly attached to the container;

a lever hingedly attached to the hinge assembly and comprising a bearing portion; and a nozzle assembly sealingly engageable with the hinge assembly and provided with an internal thread engaged with the external thread of the valve stem, the nozzle assembly being rotatable relative to the hinge assembly and the lever between open and closed positions of said nozzle assembly and including an actuator portion provided with a surface which cooperates with the lever bearing portion such that in the open position of said nozzle assembly operation of the lever causes movement of the actuator portion to open the valve and permit flow of the product out of the apparatus.

2. A dispensing apparatus according to claim 1 further comprising means for urging said product from said product chamber.

3. A dispensing apparatus according to claim 1 wherein said actuator portion comprises a ring member and wherein said surface of said actuator portion is a cam surface and comprises at least one depression and at least one raised surface.

4. A dispensing apparatus according to claim 3 wherein said cam surface comprises two depressions arranged at opposite sides of said ring member and two raised surfaces arranged between the depressions at opposite sides of said ring member.

5. A dispensing apparatus according to claim 3 wherein said lever bearing portion is adapted to bear upon one of said depressions when said nozzle assembly is in the closed position and said lever bearing portion is adapted to bear upon one of said raised surfaces when the nozzle assembly is in the open position.

6. A dispensing apparatus according to claim 1 wherein said lever comprises two lever bearing portions arranged at opposite sides of said valve.

7. A dispensing apparatus according to claim 3 wherein said nozzle assembly is provided with one or more fin members adapted to hold the lever bearing portion against the cam surface.

8. A dispensing apparatus according to claim 7 wherein one of said one or more fin members is provided at each depression and at each raised surface of the cam surface, and wherein each one of said one or more fin members is spaced from the cam surface to allow the insertion of the lever bearing portion between said each one of said one or more fin members and the cam surface.

9. A dispensing apparatus according to claim 1 wherein said container is made from aluminum.

* * * * *